US005389454A

United States Patent [19]

Wood et al.

[11] Patent Number: 5,389,454

[45] Date of Patent: Feb. 14, 1995

[54] SILICIDE COATING HAVING GOOD RESISTANCE TO MOLTEN METALS

[75] Inventors: John C. Wood; Shoichi Katoh, both of Saitama, Japan

[73] Assignee: Praxair S.T. Technology, Inc., Danbury, Conn.

[21] Appl. No.: 142,018

[22] Filed: Oct. 28, 1993

[30] Foreign Application Priority Data

Dec. 21, 1992 [JP] Japan ..... 4-356381

[51] Int. Cl.[6] ..... B32B 15/00

[52] U.S. Cl. ..... 428/641; 428/663; 428/472; 428/937

[58] Field of Search ..... 428/641, 663, 627, 672, 428/937

[56] References Cited

U.S. PATENT DOCUMENTS

| | | | |
|---|---|---|---|
| 3,837,894 | 9/1974 | Tucker, Jr. | 427/419.2 |
| 4,075,376 | 2/1978 | Jaeger | 428/937 |
| 4,230,747 | 10/1980 | Patel | 428/937 |
| 4,230,749 | 10/1980 | Patel | 428/937 |
| 4,263,353 | 4/1981 | Patel | 428/937 |
| 4,446,200 | 5/1984 | Daniels et al. | 428/663 |
| 4,657,825 | 4/1987 | Kanda et al. | 428/663 |
| 4,668,262 | 5/1987 | Kithany | 428/664 |

FOREIGN PATENT DOCUMENTS

| | | |
|---|---|---|
| 56-112447 | 9/1981 | Japan . |
| 01225761 | 9/1989 | Japan . |

*Primary Examiner*—John Zimmerman

*Attorney, Agent, or Firm*—Cornelius F. O'Brien

[57] ABSTRACT

A silicide of a refractory metal such as Cr, Mo, Ta, Nb, W, Zr, Ti and V, preferably $CrSi_2$ and $MoSi_2$ are materials that are resistant to attack by molten metals, such as zinc, and which materials can provide coatings for various articles. The method for producing the coated materials is also disclosed.

2 Claims, 1 Drawing Sheet

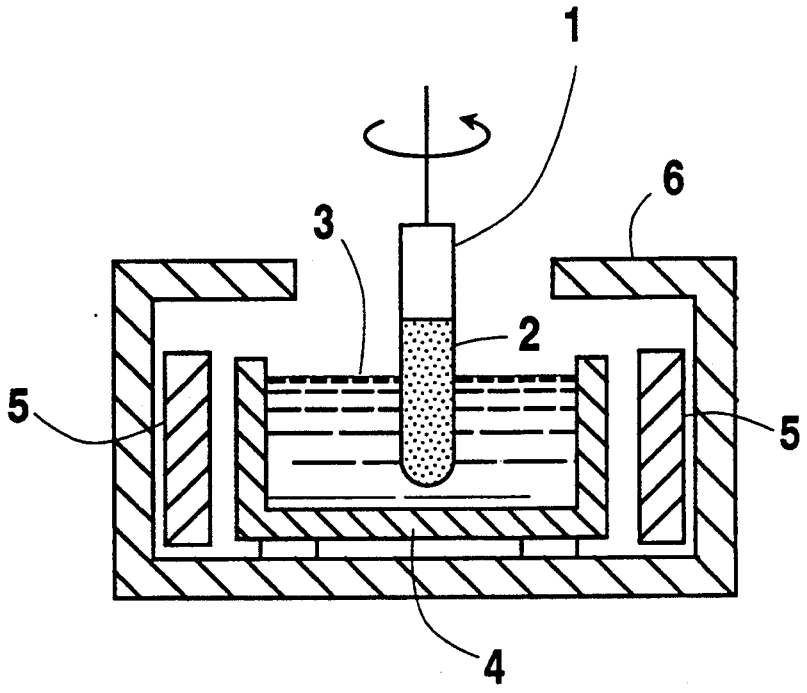
1
6
3
2
5
5
4

SILICIDE COATING HAVING GOOD RESISTANCE TO MOLTEN METALS

FIELD OF THE INVENTION

This invention relates to a silicide coating material which can prevent a component from attack by molten metal when it is contacted with a molten metal, such as molten zinc, and to a manufacturing method for producing an article having excellent resistance to attack by molten metal by forming a layer of silicide on the article.

BACKGROUND OF THE INVENTION

In the past, materials selected from heat resistant and metal attack resistant materials have been used in accordance with specific circumstances as materials which are thought to prevent attack by molten metal. Recently with demand for hot dip zinc plated steel increasing, large scale continuous galvanizing plants are being built. They need large sized components to be immersed in molten zinc such as rolls and guides, and the resistance of these components to attack by molten zinc becomes considerably important. In an attempt to provide materials that resist molten zinc, the following have been proposed: (1) W-Mo alloy, (2) self fluxing alloys and (3) thermal sprayed WC-Co. However, these materials are not satisfactory to completely prevent the zinc attack because (1) W-Mo alloy is extremely difficult to be fabricated into large shapes with reasonable cost but it does provide good protection against molten zinc, (2) self-flux alloys contain metallic constituents such as Co which are not resistant to molten zinc and (3) the method to prevent zinc penetration by thermal spraying a WC-Co layer on stainless steel made components does not have enough resistance to molten zinc due to Co binder in WC-Co coating.

An object of the invention is to solve the above mentioned problems in providing materials having excellent molten metal resistant, specially molten zinc resistant, and besides to provide manufacturing methods for producing components having excellent resistance to attack by molten metal by forming layers of the said materials on the components.

SUMMARY OF THE INVENTION

It was discovered that specific silicide refractory metals (for example Cr, Mo, Ta, Nb, W, Ti Zr, V, etc.) are stable in air or reducing atmosphere and have very low wettability with molten zinc. It was also found that some kinds of refractory metal silicides represented by $CrSi_2$ and $MoSi_2$ have excellent resistance to attack by molten zinc and that attack on components by molten zinc can be prevented by forming a layer comprising these materials on its surface to be contacted with molten zinc by thermal spraying and other coating methods.

The materials of this invention are refractory silicides expressed by a chemical formula: $MSi_2$, where M is at least one metal element selected from the group consisting of Cr, Mo, Ta, Nb, W, Zr, Ti and V which are ideal molten metal resistant materials or a main element of the materials. It was found that silicides expressed by this formula, specially refractory metal silicides of which M is Cr or Mo, has excellent resistance to and low wettability with molten metal, specially molten zinc.

The material of this invention can be used as coatings on various substrates so that a layer comprising refractory silicides expressed by the chemical formula $MSi_2$, where M is at least one metal element selected from the group consisting of Cr, Mo, Ta, Nb, W, Zr, Ti and V is the molten metal resistant component. In this case, metallic or nonmetallic material can be used for a substrate, preferably it should be a rigid body on which a dense layer of $MSi_2$ can be formed, but usually a metal made substrate is preferable considering past experiences and most preferably is a stainless steel made substrate with a WC-Co or Mo-B under layer. Since silicides such as $CrSi_2$ or $MoSi_2$ have relatively low toughness and defects such as cracks in the layer may be developed due to thermal stress caused by the mismatch of coefficient of thermal expansion between the substrate and the layer, and mechanical shock as well, it is preferable to apply an under layer such as WC-Co or Mo-B having excellent mechanical strength and some resistance to attack by molten zinc to improve the above characteristics of the silicide layer. However, in some applications, a single layer of the silicide material will have excellent resistance to molten zinc attack. That is, the most favorable example is an article resistant to attack by molten metal which has a first layer consisting of WC-Co or Mo-B on its surface and a second layer comprising a refractory metal silicide being expressed by the chemical formula: $MSi_2$, where M is at least one metal element selected from the group consisting of Cr, Mo, Ta, Nb, W, Zr, Ti and V, on the first layer, with Cr or Mo being preferable.

The invention also relates to a manufacturing method to produce an article having excellent resistance to attack by molten metal by forming a layer of $MSi_2$ on the surface of the substrate, specially on a metal made component. It was found that a thermal spraying method would be favorable for forming the $MSi_2$ layer. Low pressure plasma spraying, inert gas shrouded plasma spraying, high velocity oxy-fuel gas spraying and detonation gun spraying can all be used as a thermal spraying method. It was also found that a specially good quality layer could be produced by the detonation gun spraying technique. In the thermal spraying process, it is preferred to use a metal substrate and it is most preferred to use a metal substrate with a WC-Co or Mo-B layer on its surface.

As mentioned above, $CrSi_2$ or $MoSi_2$ is the preferred materials of this invention. It was found that a WC-Co thermal sprayed undercoating of WC-12Co showed good results as well as a Mo-7B undercoating for Mo-B.

In general, a hot dip zinc plating equipment for continuous zinc plating consists of an annealing furnace, molten zinc bath and wiping equipment. The atmosphere of the annealing furnace is reducing while the atmosphere in the zinc bath is air, neutral or weak reducing atmosphere. The gas wiping equipment is operated in air or a weak reducing atmosphere depending on the wiping gas used.

Since components installed in the zinc pot, such as rolls, guides and partition walls, are in the air or reducing atmosphere they are nevertheless immersed in or outside of molten zinc. This is true specially for rolls at least partially exposed to molten zinc and these rolls are generally made with conventionally bare stainless steel or one combined with a layer of WC-Co or self-fluxing alloy formed on the part to be contacted with the molten zinc to provide the necessary corrosion resistance. However, they are not satisfactory. Silicides of refractory metals such as $CrSi_2$ and $MoSi_2$ provided by the present invention were found to be very stable in the above atmosphere and resistant to attack by molten zinc and low wettability with zinc.

Coatings with Co-base self-fluxing and WC-Co alloy which contain Co as a constituent or binder metal have been used. Since Co-Zn has a eutectic point at the zinc rich side (Zn 99%, Co 1%) at 410° C. and Co could easily be dissolved in a molten zinc bath (approx. 470° C.), then these coatings are less resistant to attack by molten zinc. Therefore the resistant to molten zinc is significantly improved by forming $CrSi_2$ or $MoSi_2$ on stainless steel or on an under layer of WC-Co or self-fluxing coated layer on stainless steel. The details of the present invention will be described by the following examples.

BRIEF DESCRIPTION OF THE DRAWING

The sole drawing shows a cross-section of a zinc bath used for zinc immersion testing of coated samples.

EXAMPLE $CrSi_2$ or $MoSi_2$ is coated on seven stainless steel (SUS403) bar samples as follows:

Sample 1. $CrSi_2$ is directly coated on the stainless steel bar.

Sample 2. $CrSi_2$ is applied on WC-12Co layer coated on the stainless steel bar.

Sample 3. $MoSi_2$ layer is directly coated on the stainless steel bar.

Sample 4. $MoSi_2$ is applied on WC-12Co layer coated on the stainless steel bar.

Sample 5. $MoSi_2$ is applied on Mo-7B layer coated on the stainless steel bar.

Sample 6. $CrSi_2$ is applied on Mo-7B layer coated on the stainless steel bar.

Sample 7. WC-12Co is coated on the stainless steel bar.

As shown in the drawing, each sample 1 having a coated area 2 was immersed in molten zinc 3 containing 0.1% aluminum kept in a graphite pot 4 equipped on a furnace 6, keeping the temperature at 470° C. by heater 5. After immersing samples for a certain time period, the coated surface of the samples were observed visually and/or by microscope to check adhesion of zinc and degradation of the coatings. Various samples, immersion time and results are summarized in Table 1. The Sample Nos. 1 to 6 are examples of the present invention while the Sample No. 7 is for comparison. Zinc was strongly adhered on the Sample No. 7. There was no evidence of zinc adhesion observed on Sample Nos. 1 to 6, but cracks and chipping of the coating were observed both on No. 1 and No. 3 which have no under coating such as WC-Co and Mo-7B. This indicates $CrSi_2$ and $MoSi_2$ coated layers have excellent resistance to attack by molten zinc.

Since the test models the condition of a plant operation, the data show that silicide of refractory metals had excellent resistance to molten zinc, that is, Sample Nos. 2, 4, 5 and 6 showed no degradation after each was tested for a specified time period.

TABLE 1

| | Results of Zinc Immersion Test | | | |
|---|---|---|---|---|
| | Top Coating | Under coating | Exposure Time | Results |
| Sample 1 | $CrSi_2$ | — | 500 hours | No reaction with zinc, but some chipping due to thermal stresses |
| Sample 2 | $CrSi_2$ | WC-12Co | 1000 hours | No indication of damage or reaction after 1000 hr exposure to zinc |
| Sample 3 | $MoSi_2$ | — | 400 hours | Cracking due to CTE mismatch. No reaction with zinc |
| Sample 4 | $MoSi_2$ | WC-12Co | 800 hours | No cracking or reaction with zinc |
| Sample 5 | $MoSi_2$ | Mo-7B | 400 hours | Denser structure and oxide presence in coating |
| Sample 6 | $CrSi_2$ | Mo-7B | 400 hours | Denser structure and oxide presence in coating |
| Sample 7 Comparison | WC-12Co | — | 100 hours | Zinc strongly adheres |

CTE = Coefficient of Thermal Expansion

In addition to the above test, a hardness test for coatings was separately conducted. The results of the test on chromium silicide and molybdenum silicide coatings are shown in Table 2. As shown in Table 2, the coatings sprayed by the detonation gun spraying method have excellent hardness characteristics.

TABLE 2

| Coating | $CrSi_2$ | | $MoSi_2$ | |
|---|---|---|---|---|
| Process | *D-Gun | Plasma | *D-Gun | Plasma |
| **Hardness | 795 | 662 | 883 | 594 |

*Detonation Gun Spraying
**Hardness is measured by Vickers with 500 g load.

Formation of oxides of refractory metals in silicides can be expected at extremely high temperature in plasma flame when they are coated in air. This oxidation will cause degradation of the coating. Plasma spraying shield by inert gas such as nitrogen or argon or low pressure plasma spraying is favorable to avoid this oxidation. The amount of oxide in the layers coated with the above process observed by SEM (Scanning Electron Microscope) and X-Ray refractometers was negligible for practical use. Compared to plasma spraying, detonation gun spraying is operated at a relatively lower temperature and in neutral atmosphere and thus no significant oxidation which causes degradation of the coatings is to be expected.

Although all these tests were carried out for $CrSi_2$ and $MoSi_2$ layers and since Ta, Nb, W, Zr, Ti and V are though to have the same characteristics with the above refractory metals, then silicides of these metals should show the same effects. Only zinc was tested in examples of $CrSi_2$ and $MoSi_2$, but the same results are expected for other molten metals. Although silicides of refractory metal are resistant to attack by molten metal in the present invention, such silicides are not limited to $CrSi_2$ and $MoSi_2$ for molten zinc.

What is claimed is:

1. An article resistant to attack by molten metal comprising a substrate having a first layer consisting of Mo-B on its surface and a top layer comprising a refractory metal silicide being expressed by the formula: $MSi_2$, where M is at least one metal element selected from the group consisting of Cr, Mo, Ta, Nb, W, Zr, Ti and V, on the first layer.

2. An article resistant to attack by molten metal comprising a substrate having a first layer consisting of WC-Co on its surface and a top layer comprising a refractory metal silicide being expressed by the formula: $MSi_2$, where M is at least one metal element selected from the group consisting of Cr, Mo, Ta, Nb, W, Zr, Ti and V, on the first layer.

* * * * *